US007766509B1

(12) United States Patent
Laporte

(10) Patent No.: US 7,766,509 B1
(45) Date of Patent: Aug. 3, 2010

(54) ORIENTABLE LENS FOR AN LED FIXTURE

(75) Inventor: Jean-Francois Laporte, Boisbriand (CA)

(73) Assignee: Lumec Inc., Boisbriand (CA)

( * ) Notice: Subject to any disclaimer, the term of this patent is extended or adjusted under 35 U.S.C. 154(b) by 124 days.

(21) Appl. No.: 12/171,362

(22) Filed: Jul. 11, 2008

Related U.S. Application Data

(60) Provisional application No. 61/061,392, filed on Jun. 13, 2008.

(51) Int. Cl.
*F21S 4/00* (2006.01)
*F21V 21/00* (2006.01)

(52) U.S. Cl. ..... 362/249.02; 362/249.03; 362/283; 362/311.02; 362/323; 362/327; 362/800

(58) Field of Classification Search ..... 362/249.01–249.04, 277, 282–283, 311.02, 362/322–323, 327, 800
See application file for complete search history.

(56) References Cited

U.S. PATENT DOCUMENTS

| | | | |
|---|---|---|---|
| 2,908,197 | A | 10/1959 | Well et al. |
| 3,596,136 | A | 7/1971 | Fischer |
| 3,711,722 | A | 1/1973 | Kavanagh |
| 3,774,021 | A | 11/1973 | Johnson |
| 4,161,770 | A | 7/1979 | Maurer |
| 4,698,730 | A | 10/1987 | Sakai et al. |
| 4,860,177 | A | 8/1989 | Simms |
| 4,941,072 | A | 7/1990 | Yasumoto et al. |
| 5,130,897 | A | 7/1992 | Kuzma |
| 5,140,220 | A | 8/1992 | Hasegawa |
| 5,335,157 | A | 8/1994 | Lyons |
| 5,481,440 | A | 1/1996 | Oldham et al. |
| 5,485,317 | A | 1/1996 | Perissinotto et al. |
| 5,608,290 | A | 3/1997 | Hutchisson et al. |
| 5,636,057 | A | 6/1997 | Dick et al. |
| 5,924,788 | A | 7/1999 | Parkyn, Jr. |
| 6,045,240 | A | 4/2000 | Hochstein |
| 6,050,707 | A | 4/2000 | Kondo et al. |
| 6,177,761 | B1 | 1/2001 | Pelka et al. |
| 6,227,685 | B1 | 5/2001 | McDermott |
| 6,273,596 | B1 | 8/2001 | Parkyn, Jr. |
| 6,296,376 | B1 | 10/2001 | Kondo et al. |
| 6,361,191 | B1 | 3/2002 | Simon |
| 6,450,661 | B1 | 9/2002 | Okumura |
| 6,560,038 | B1 | 5/2003 | Parkyn, Jr. et al. |
| 6,598,998 | B2 | 7/2003 | West et al. |
| 6,607,286 | B2 | 8/2003 | West et al. |
| 6,623,150 | B2 | 9/2003 | Roller et al. |
| 6,679,621 | B2 | 1/2004 | West et al. |
| 6,784,357 | B1 | 8/2004 | Wang |
| 6,837,605 | B2 | 1/2005 | Reill |
| 6,850,001 | B2 | 2/2005 | Takekuma |

(Continued)

FOREIGN PATENT DOCUMENTS

| | | | |
|---|---|---|---|
| JP | 11154766 | A | 6/1999 |

(Continued)

*Primary Examiner*—Jason Moon Han

(57) ABSTRACT

A mounting surface for mounting a plurality of LEDs has a plurality of orientable lenses each individually affixed about a single LED. Each orientable lens has a primary reflector and a refracting lens that direct light emitted from a single LED to a reflective surface of the orientable lens that reflects the light off a primary LED light output axis.

42 Claims, 11 Drawing Sheets

U.S. PATENT DOCUMENTS 6,942,361 B1 9/2005 Kishimura et al.
6,948,838 B2 9/2005 Kunstler
6,951,415 B2 10/2005 Amano et al.
6,965,715 B2 11/2005 Lei et al.
6,986,593 B2 1/2006 Rhoads et al.
6,997,580 B2 2/2006 Wong
7,006,306 B2 2/2006 Falicoff et al.
7,009,213 B2 3/2006 Camras et al.
7,021,801 B2 4/2006 Mohacsi
7,034,343 B1 4/2006 Kim et al.
7,040,767 B2 5/2006 Lee et al.
7,083,313 B2 8/2006 Smith
7,090,389 B2 8/2006 Parker et al.
7,104,672 B2 9/2006 Zhang
7,111,964 B2 9/2006 Suehiro et al.
7,118,262 B2 10/2006 Negley
7,142,769 B2 11/2006 Hsieh et al.
7,144,121 B2 12/2006 Minano et al.
7,153,000 B2 12/2006 Park et al.
7,153,002 B2 12/2006 Kim et al.
7,172,319 B2 2/2007 Holder et al.
7,172,324 B2 2/2007 Wu et al.
7,181,378 B2 2/2007 Benitez et al.
7,276,737 B2 10/2007 Camras et al.
7,281,816 B2 10/2007 Suzuki
7,281,833 B2 10/2007 Akiyama
7,322,718 B2 1/2008 Setomoto et al.
7,390,109 B2 1/2008 Li et al.
7,334,918 B2 2/2008 Newton et al.
7,339,200 B2 3/2008 Amano et al.
7,339,202 B2 3/2008 Chiu et al.
7,348,723 B2 3/2008 Yamaguchi et al.
7,387,405 B2 6/2008 Ducharme et al.
7,431,492 B2 10/2008 Ohkawa
7,454,119 B2 11/2008 Hsieh et al.
7,458,703 B2 12/2008 Han et al.
7,473,014 B2 1/2009 Katoh et al.
7,549,769 B2 6/2009 Kim et al.
7,572,036 B2 8/2009 Yoon et al.
7,582,913 B2 9/2009 Huang et al.
7,602,559 B2 10/2009 Jang et al.
7,618,160 B2 11/2009 Chinniah et al.
7,618,163 B2 11/2009 Wilcox
7,637,630 B2 * 12/2009 Wilcox et al. ..... 362/267
7,674,018 B2 3/2010 Holder et al.
7,688,526 B2 3/2010 Lu et al.
2004/0037076 A1 2/2004 Katoh et al.
2004/0105264 A1 6/2004 Spero
2004/0228127 A1 11/2004 Squicciarini
2005/0265029 A1 12/2005 Epstein et al.
2006/0181866 A1 8/2006 Jung et al.
2006/0250803 A1 11/2006 Chen
2006/0255353 A1 11/2006 Taskar et al.
2006/0285311 A1 12/2006 Chang et al.
2007/0066310 A1 3/2007 Haar et al.
2007/0081340 A1 4/2007 Chung et al.
2007/0091615 A1 4/2007 Hsieh et al.
2007/0183736 A1 8/2007 Pozdnyakov et al.
2007/0253080 A1 11/2007 Yokote et al.
2008/0013322 A1 1/2008 Ohkawa
2008/0100773 A1 5/2008 Hwang et al.
2008/0204888 A1 8/2008 Kan et al.
2008/0273327 A1 11/2008 Wilcox et al.

FOREIGN PATENT DOCUMENTS

WO 3044870 A1 5/2003
WO 2005093316 A1 10/2005
WO 2007100837 A2 9/2007

* cited by examiner

ORIENTABLE LENS FOR AN LED FIXTURE

CROSS-REFERENCE TO RELATED APPLICATIONS

This application under 35 USC §119(e) claims priority to, and benefit from, U.S. Provisional Application No. 61/061,392, filed Jun. 13, 2008, entitled "Orientable Lens for a LED Fixture," which is currently pending, naming Jean-François Laporte as the sole inventor.

BACKGROUND OF THE INVENTION

1. Field of the Invention

The present invention is related generally to an orientable lens, and more specifically to an orientable lens for a light emitting diode fixture.

2. Description of Related Art

Light emitting diodes, or LEDs, have been used in conjunction with various lenses that reflect light emitted by the LED. Also, various lenses have been provided for use in light fixtures utilizing a plurality of LEDs as a light source.

DETAILED DESCRIPTION

Figure 1:
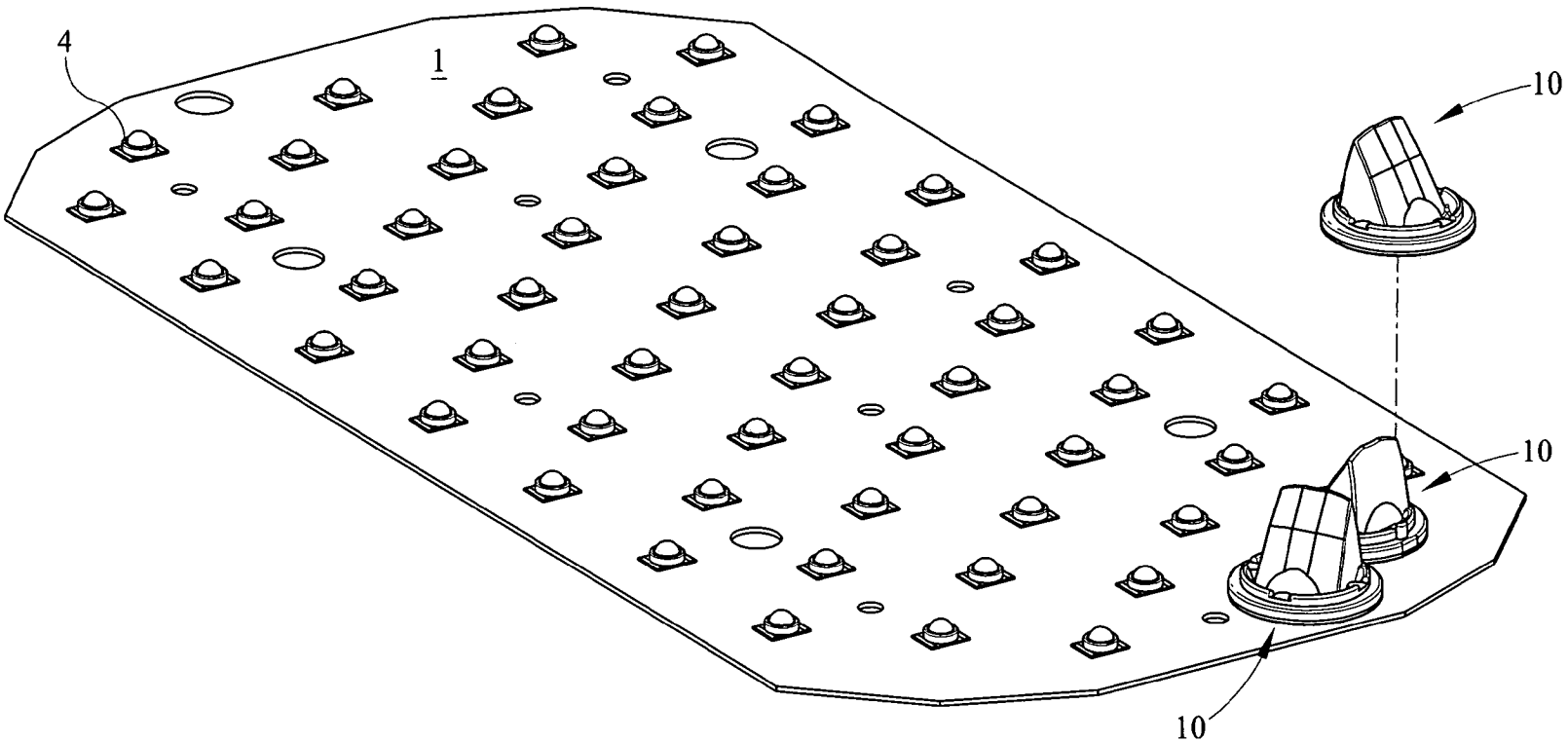
FIG. 1 is a top perspective view of the LED fixture with orientable lens of the present invention wherein a flat board is populated with a plurality of LEDs and shown with three orientable lenses, two of which are affixed to the flat board about respective LEDs and one of which is shown exploded away from its respective LED.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now in detail to FIGS. 1-10, wherein like numerals indicate like elements throughout the several views, there are shown various aspects of an orientable lens for a LED fixture. Orientable lens is usable in conjunction with a single LED and may be installed and used with a variety of LEDs. Orientable lens is preferably used as a lens for a LED with a Lambertian light distribution although it may be configured for and used as a lens for LEDs having other light distributions as well. FIG. 1 shows a LED flat board 1, on which is mounted fifty-four LEDs 4 with a Lambertian light distribution. In some embodiments of LED flat board 1, LED flat board 1 is a metallic board with advantageous heat distribution properties such as, but not limited to, aluminum. In other embodiments LED flat board 1 is a flame retardant 4 (FR-4) or other common printed circuit board. LED flat board 1 and plurality of LEDs 4 are merely exemplary of the multitude of boards, number of LEDs, and multitude of LED configurations in which a plurality of orientable lenses for a LED may be used. Design considerations such as, but not limited to, heat, desired lumen output, and desired light distribution pattern may result in a choice of differing amounts of LEDs, differing LED configurations, and/or differing materials.

Also shown in FIG. 1 are three of one embodiment of orientable lens 10, two of which are shown placed over respective LEDs 4 and mated to flat board 1 and one of which is shown exploded away from its respective LED 4. Being orientable means that each lens is individually adjustable to a given orientation about a given LED. As will become clear, when a plurality of orientable lenses 10 are used in conjunction with a plurality of LEDs, each orientable lens 10 may be individually oriented without regard to the orientation of other orientable lenses 10, such as, for example, the three orientable lenses 10 of FIG. 1 which are each oriented in a unique direction. Moreover, when a plurality of LEDs are present, as few as one LED, or as many as all LEDs in some preferred embodiments, may be provided with an individual orientable lens 10. Some or all lenses may be individually and permanently adjusted to a given orientation upon creation of the LED fixture with an orientable lens or some or all lenses may be attached to allow for adjustment in the field. Thus, complex photometric distribution patterns and a flexibility of distribution patterns may be achieved when using a plurality of orientable lenses 10 with a plurality of LEDs, such as, but not limited to, plurality of LEDs 4 on flat board 1.

Figure 2:
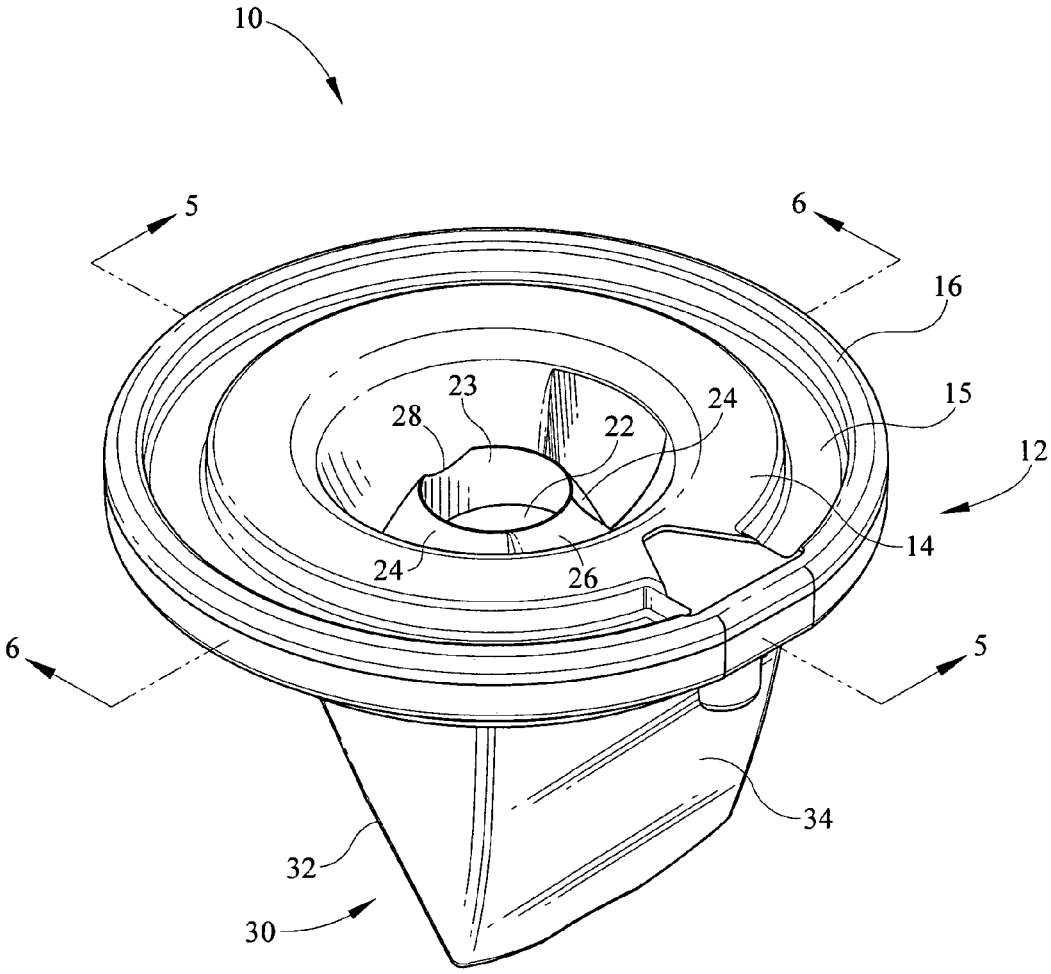
FIG. 2 is a top perspective view of one of the orientable lenses of FIG. 1.
Figure 3:
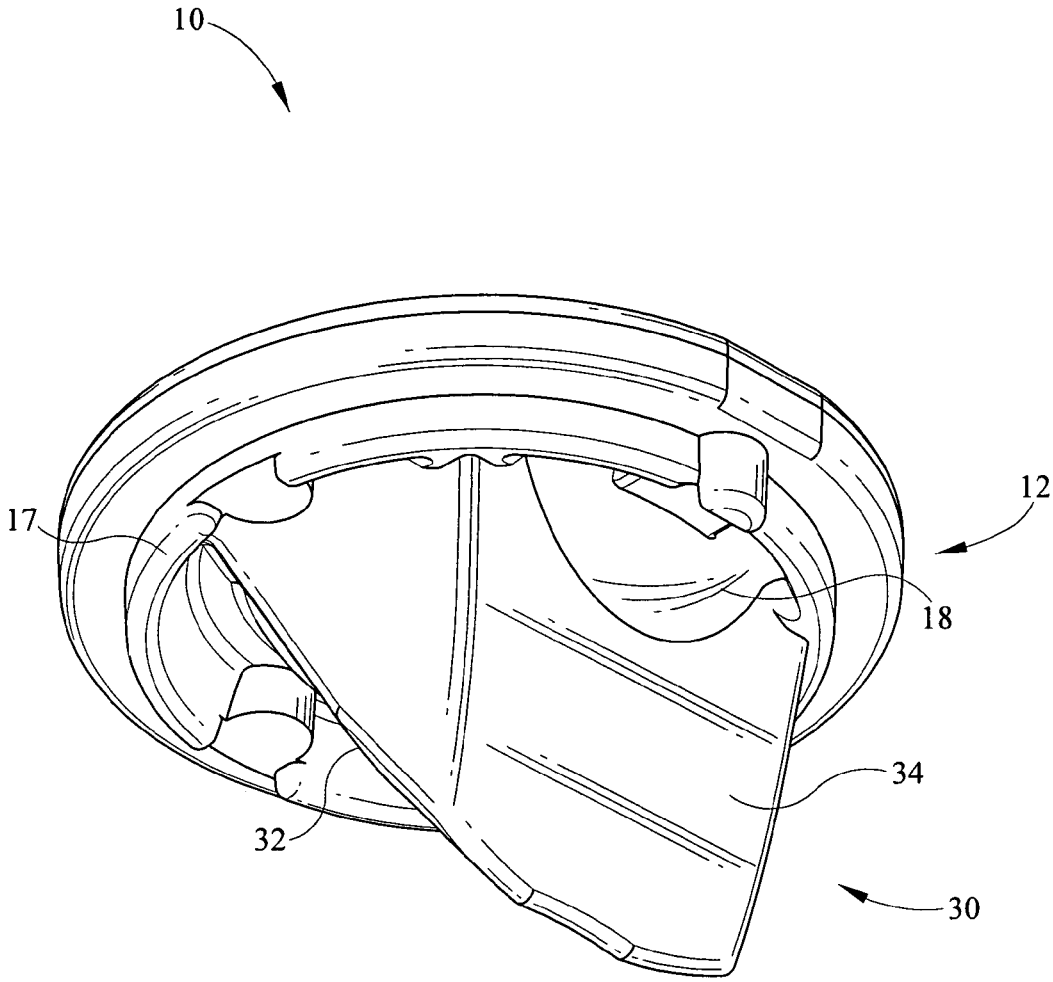
FIG. 3 is a bottom perspective view of the orientable lens of FIG. 2.
Figure 4A:
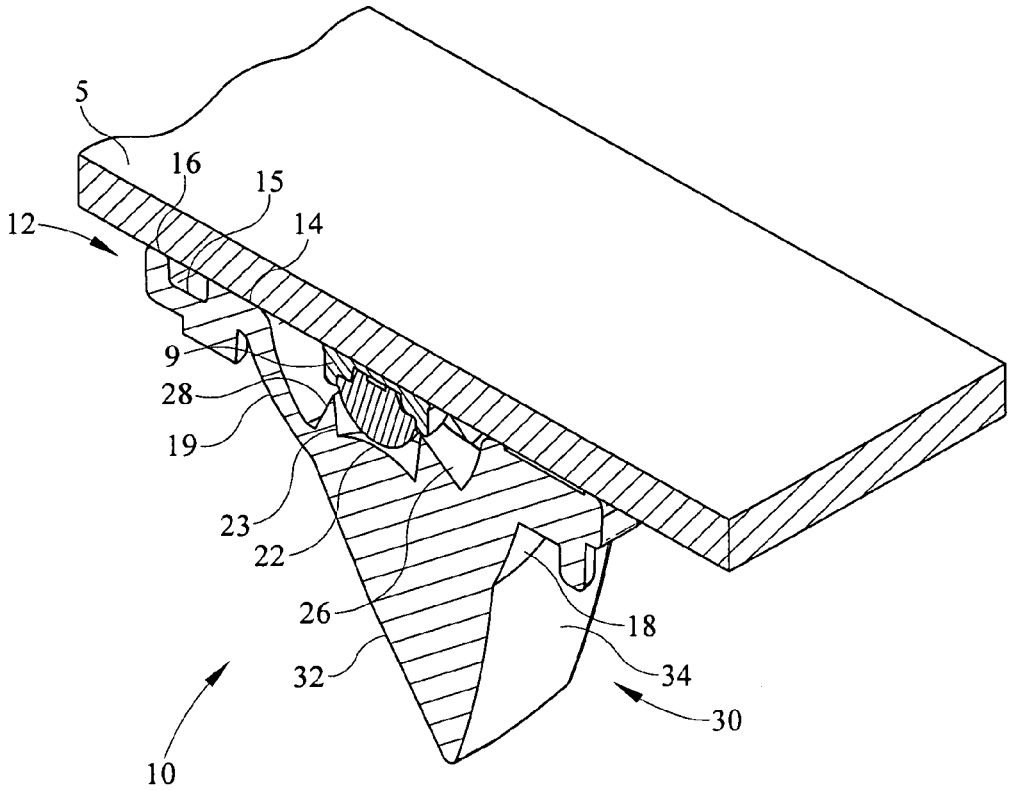
FIG. 4A is a top perspective view of the orientable lens of FIG. 2 taken along the line 5-5, and a sectioned view of a LED attached to a mounting surface, with the orientable lens affixed to the mounting surface about the LED.
Figure 4B:
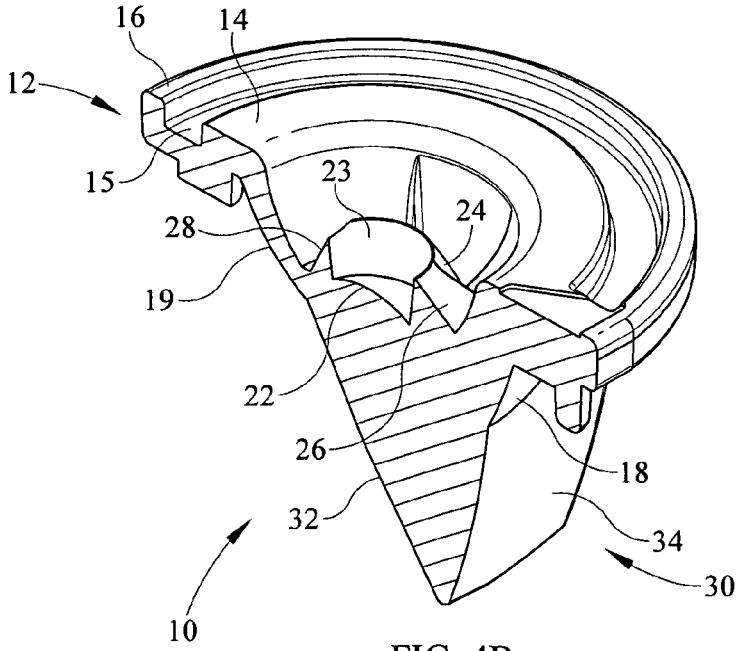
FIG. 4B is a top perspective view of the orientable lens of FIG. 2 taken along the line 5-5.

Turning now to FIG. 2 and FIG. 3, an embodiment of orientable lens 10 is shown in more detail. Orientable lens 10 has a base 12 that is shown in this embodiment as having a substantially flat and substantially circular inner and outer mating surface 14 and 16, each with substantially circular inner and outer peripheries. Base 12 of FIG. 2 is also shown with a recessed portion 15 provided in between a substantial portion of inner and outer mating surfaces 14 and 16. Base 12 is provided, among other things, for attachment of orientable lens 10 to a surface on which a LED is mounted, such as, for example, attachment to flat board 1 of FIG. 1. Attachment of base 12 to a surface on which a LED is mounted and not to a LED itself reduces heat transfer from a LED to orientable lens 10. In some embodiments both inner and outer mating surface 14 and 16 mate with a surface for attachment of orientable lens 10. In some embodiments only inner mating surface 14 mates with a surface for attachment of orientable lens 10 and outer mating surface 16 interacts with a surface for alignment of orientable lens 10 about an LED. In some embodiments inner and/or outer mating surface 14 and 16 or other provided surface may be adhered to a mounting surface for attachment of orientable lens 10. In some embodiments inner and/or outer mating surface 14 and 16 or other provided surface may be snap fitted with a mounting surface for attachment of orientable lens 10. In some embodiments inner and/or outer mating surface 14 and 16 or other provided surface may be compressed against a mounting surface for attachment of orientable lens 10. Other attachment means of base 12 to a mounting surface may be provided as are generally known to those of ordinary skill in the art and as may be based on the teachings hereof.

Figure 6A:
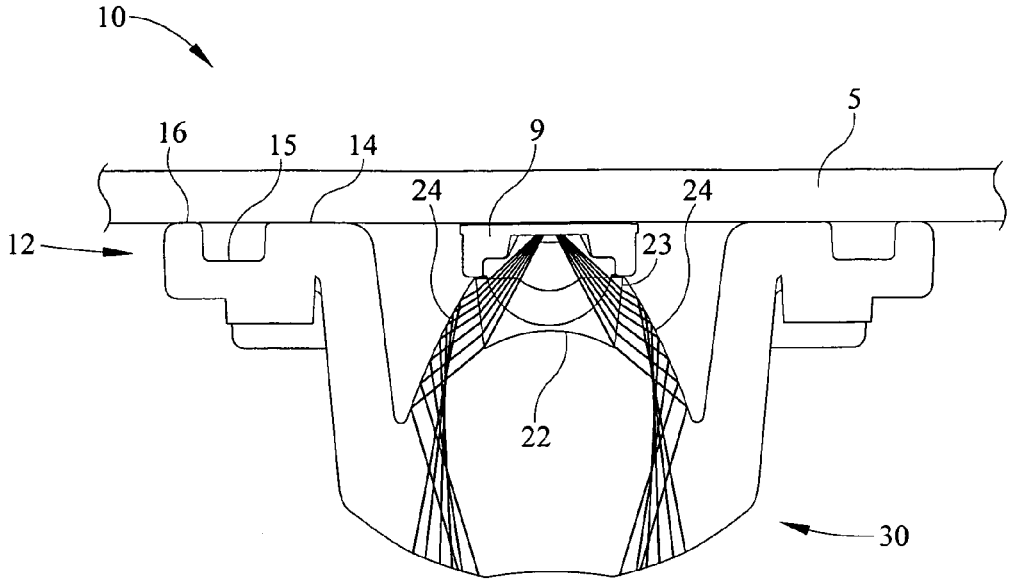
FIG. 6A is a sectional view of the orientable lens of FIG. 2 taken along the line 6-6 and shown with a ray trace of exemplary light rays that emanate from a source and contact portions of a primary reflector.
Figure 6B:
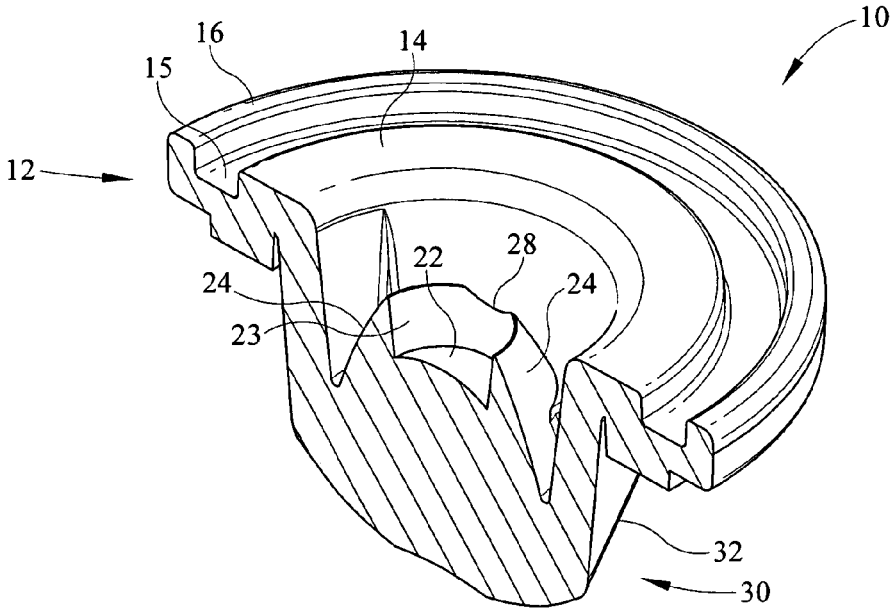
FIG. 6B is a front top perspective view of the orientable lens of FIG. 2 taken along the line 6-6.

Base 12 also has portions that may be provided for aesthetic purposes or support or attachment of other constituent parts of orientable lens 10. For example, in some preferred embodiments, at least primary reflector 24 (as shown in FIG. 6A) and reflecting prism 30 are attached to and supported by base 12. Some embodiments of orientable lens 10 may be provided with a base 12 having supports 18 or 19 that may help provide for support of reflecting prism 30 and may also be provided to fully seal orientable lens 10. Some embodiments of base 12 of orientable lens 10 may also be provided with rim portion 17 and like appendages if desired for ease in installation or other reasons. In some embodiments, when orientable lens is installed about a LED on a mounting surface, a sheet or other object may contact rim portion 17, or other portions of base 12, such as the flange portion provided around rim portion 17 and provide compressive force on orientable lens 10 in the direction of the mounting surface, thereby causing inner and/or outer mating surfaces 14 and 16 to mate with the mounting surface for attachment of orientable lens 10.

In other embodiments base 12 may take on different shapes and forms so long as it enables orientable lens 10 to be appropriately used with a given LED and be installable at any orientation around an LED light output axis, the LED light output axis being an axis emanating from the center of the light emitting portion of any given LED and oriented away from the LED mounting surface. For example, base 12 may be provided in some embodiments without recessed portion 15 and with only one distinct mating surface, as opposed to inner and outer mating surfaces 14 and 16 shown in. Also, for example, base 12 may be provided with inner and/or outer peripheries that have a shape other than circular. Also, for example, base 12 may be provided with other configurations for attachment to and/or support of constituent parts of orientable lens 10, such as primary reflector 24 and reflecting prism 30. Other variations on base 12 will be apparent to one skilled in the art.

Also shown in FIG. 2 are portions of a refracting lens 22, primary reflector 24, a surface 26, a reflecting portion 28, and reflecting prism 30. When orientable lens 10 is placed about an LED and base 12 is affixed to a surface, such as LED 9 and surface 5 of FIG. 4A, FIG. 5A, FIG. 5B, and FIG. 6A, refracting lens 22 and primary reflector 24 are proximal LED 9. In particular, primary reflector 24 is positioned such that it partially surrounds the light emitting portion of LED 9 and refracting lens 22 is positioned such that it intersects the LED light output axis of LED 9 and is partially surrounded by primary reflector 24. In some embodiments primary reflector 24 is a parabolic reflector. Refracting lens 22 and primary reflector 24 are positioned so that a majority of light emitted from LED 9 will collectively be incident upon one of the two. In some embodiments, primary reflector 24 may be provided such that it completely surrounds the light emitting portion of LED 9. In some embodiments, such as those shown in the figures, primary reflector 24 only partially surrounds the light emitting portion of LED 9 and reflecting portion 28 is provided on one side of the light emitting portion of LED 9 positioned adjacent primary reflector 24 and surface 26 is provided on a substantially opposite side of the light emitting portion of LED 9 and also positioned adjacent primary reflector 24.

In some additional embodiments refracting lens 22 is positioned at the base of sidewall 23 and sidewall 23 substantially surrounds the light emitting portion of LED 9. A majority of rays emanating from LED 9 and incident upon refracting lens 22 will be refracted such that they are directed towards a reflective surface 32 of reflecting prism 30. In some embodiments, refracting lens 22 is configured such that it refracts rays so they are substantially collimated towards reflective surface 32, such as the exemplary rays shown in FIG. 5A.

In other embodiments, other rays emanating from LED 9 will be incident upon sidewall 23 proximal primary reflector 24, pass therethrough at an altered angle and will be incident upon primary reflector 24. A majority of rays incident upon primary reflector 24 are reflected and directed towards reflective surface 32 of reflecting prism 30, such as the exemplary rays shown in FIG. 6A which are directed towards portions of reflective surface 32 not shown in the figure, but evident from reference to other figures. In some embodiments of orientable lens 10, primary reflector 24 has a composition and orientation such that a majority of rays incident upon it are internally reflected and directed towards reflective surface 32. In other embodiments, primary reflector 24 is composed of a reflective material.

In additional embodiments, other rays emanating from LED 9 will be incident upon sidewall 23 proximal reflecting portion 28, pass therethrough at an altered angle and will be incident upon reflecting portion 28. A majority of rays incident upon reflecting portion 28 are reflected and directed towards reflective surface 32 of reflecting prism 30, such as the exemplary rays shown incident upon reflecting portion 28 and directed towards reflective surface 32 in FIG. 5B. In some embodiments reflecting portion 28 is positioned and configured to direct light rays in a unique direction from those rays directed by primary reflector 24 and refracting lens 22 such that they also exit orientable lens 10 in a unique direction. In embodiments of orientable lens 10 reflecting portion 28 has a composition and orientation such that a majority of rays incident upon it are internally reflected and directed towards reflective surface 32. In other embodiments, reflecting portion 28 is composed of a reflective material.

Figure 5A:
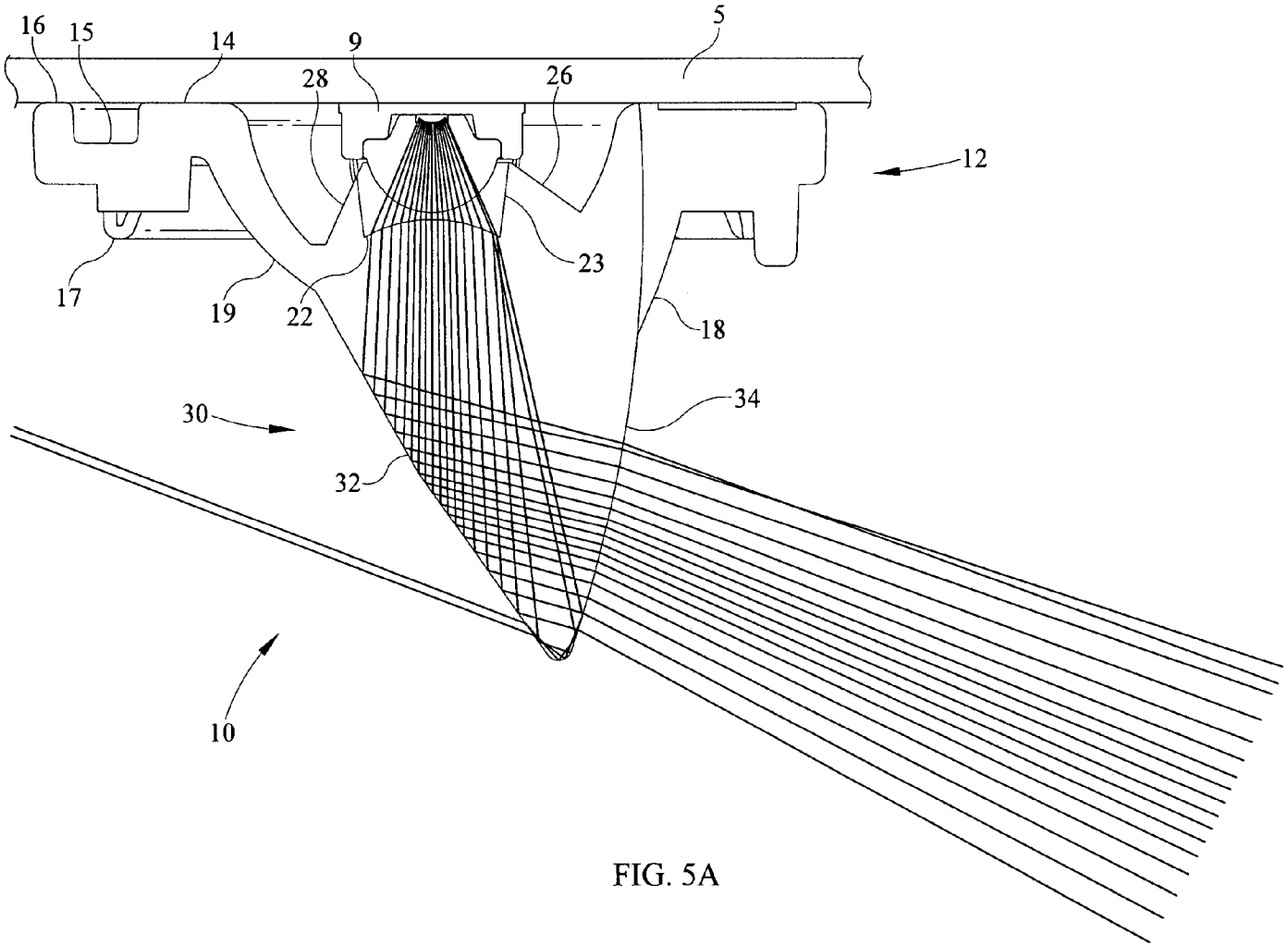
FIG. 5A is a sectional view of the orientable lens of FIG. 2 taken along the line 5-5 and shown about a LED with a ray trace of exemplary light rays that emanate from the LED and contact the refracting lens.
Figure 5B:
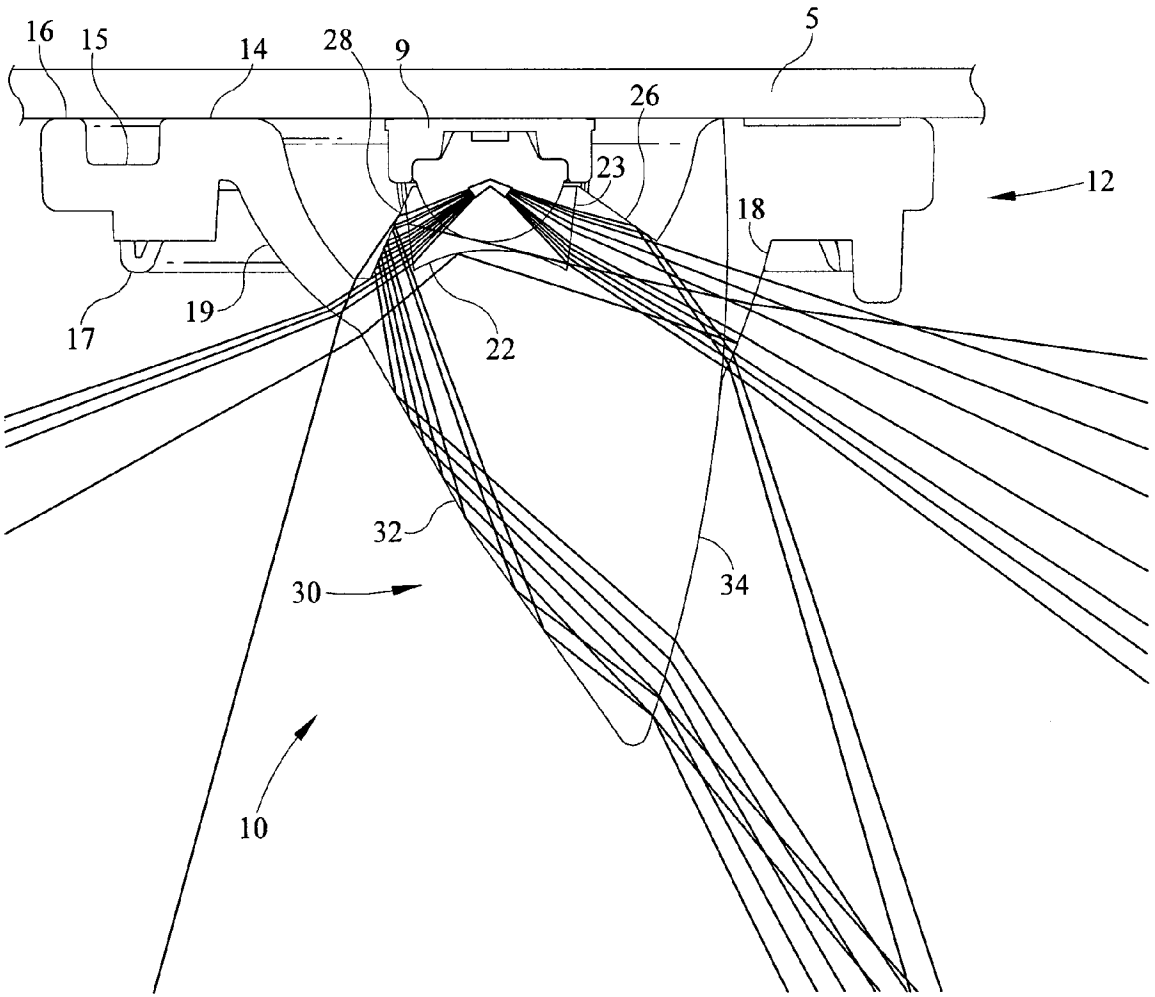
FIG. 5B is a sectional view of the orientable lens of FIG. 2 taken along the line 5-5 and shown about a LED with a ray trace of exemplary light rays that emanate from the LED and pass through a sidewall and either contact a reflecting portion or are directed towards an optical lens.

In some embodiments, other rays emanating from LED 9 will be incident upon sidewall 23 proximal surface 26, pass therethrough at an altered angle and will be directed towards an optical lens 34 of reflecting prism 30, such as the exemplary rays shown in FIG. 5B. A majority of these rays will pass through optical lens 34 and many of the rays will also pass through support 18 as shown in FIG. 5B. Also, as shown in FIG. 5B, some light rays may also be incident upon surface 26 and reflected and directed towards lens 34 and potentially support 18. One skilled in the art will recognize that varying configurations of orientable lens 10 may call for varying configurations of any or all of refracting lens 22, sidewall 23, primary reflector 24, surface 26, and reflecting portion 28 in order to achieve desired light distribution characteristics.

In some embodiments, sidewall 23 is provided for provision of refracting lens 22 and many rays pass through sidewall 23 prior to being incident upon primary reflector 24 and potentially reflecting portion 28 and surface 26. In some embodiments sidewall 23 alters the travel path of rays passing therethrough. In some embodiments the height of sidewall 23 is shortened near its connection with reflecting portion 28. In other embodiments refracting lens 22 is positioned using thin supports attached to the inner surface of primary reflector 24 or otherwise and sidewall 23 is not provided. Also, in some embodiments, such as shown in the figures, sidewall 23 is provided and orientable lens 10 is formed from an integral molded solid unit of an appropriate medium. In these embodiments where orientable lens 10 forms an integral molded solid unit, once light rays emitted from LED enter orientable lens 10, they travel through the appropriate medium until they exit orientable lens 10. In some embodiments the medium is optical grade acrylic and all reflections occurring within orientable lens 10 are the result of internal reflection.

Reflective surface 32 of reflecting prism 30 may have a composition and orientation such that rays that have been collimated by refracting lens 22 or reflected by primary reflector 24 or reflecting portion 28 and directed towards reflective surface 32 are reflected off reflective surface 32 and directed towards optical lens 34, such as those rays shown in FIGS. 5A and 5B. Preferably the rays are internally reflected off reflective surface 32, although reflective surface 32 could also be formed of a reflective material. Most rays incident upon optical lens 34 pass through optical lens 34, potentially at an altered angle in some embodiments. Preferably, the direction of rays passing through optical lens 34 is only slightly altered. In embodiments where constituent parts of orientable lens 10 form an integral molded solid unit, reflective surface 32 internally reflects any rays incident upon it and rays that emanate from an LED and enter orientable lens 10 travel through the medium of orientable lens 10 until they exit orientable lens 10 through optical lens 34 or otherwise.

Reflective surface 32 of reflecting prism 30 need not be a flat surface. In some embodiments, such as those shown in the figures, reflective surface 32 actually comprises two faces at slightly different angles in order to allow more accurate control of light reflected from reflective surface 32 and to allow for a narrower range of light rays to be emitted by orientable lens 10. In other embodiments a reflective surface may be provided that is curved, concave, convex, or provided with more than two faces. Similarly, optical lens 34 may take on varying embodiments to allow more accurate control of light reflected from reflective surface 32 and/or to allow for a narrower range of light rays to be emitted by orientable lens 10.

Through use of orientable lens 10, the light emitted from a given LED is able to be redirected from the LED light output axis at angle from the LED light output axis. Since orientable lens 10 is installable at any orientation around an LED light output axis, this light can likewise be distributed at any orientation around an LED light output axis. Dependent on the configuration of a given orientable lens 10 and its constituent parts, the angle at which light emitted from an LED is redirected off its light output axis can vary. Moreover, the spread of the light beam that is redirected can likewise vary. When a plurality of orientable lenses 10 are used on a plurality of LEDS mounted on a surface, such as flat board 1 and plurality of LEDs 4, each orientable lens 10 can be installed at any given orientation around an LED axis without complicating the mounting surface. Moreover, complex photometric distribution patterns and a flexibility of light distributions can be achieved with a plurality of LEDs mounted on a surface, such as flat board 1 and plurality of LEDs 4.

Figure 7:
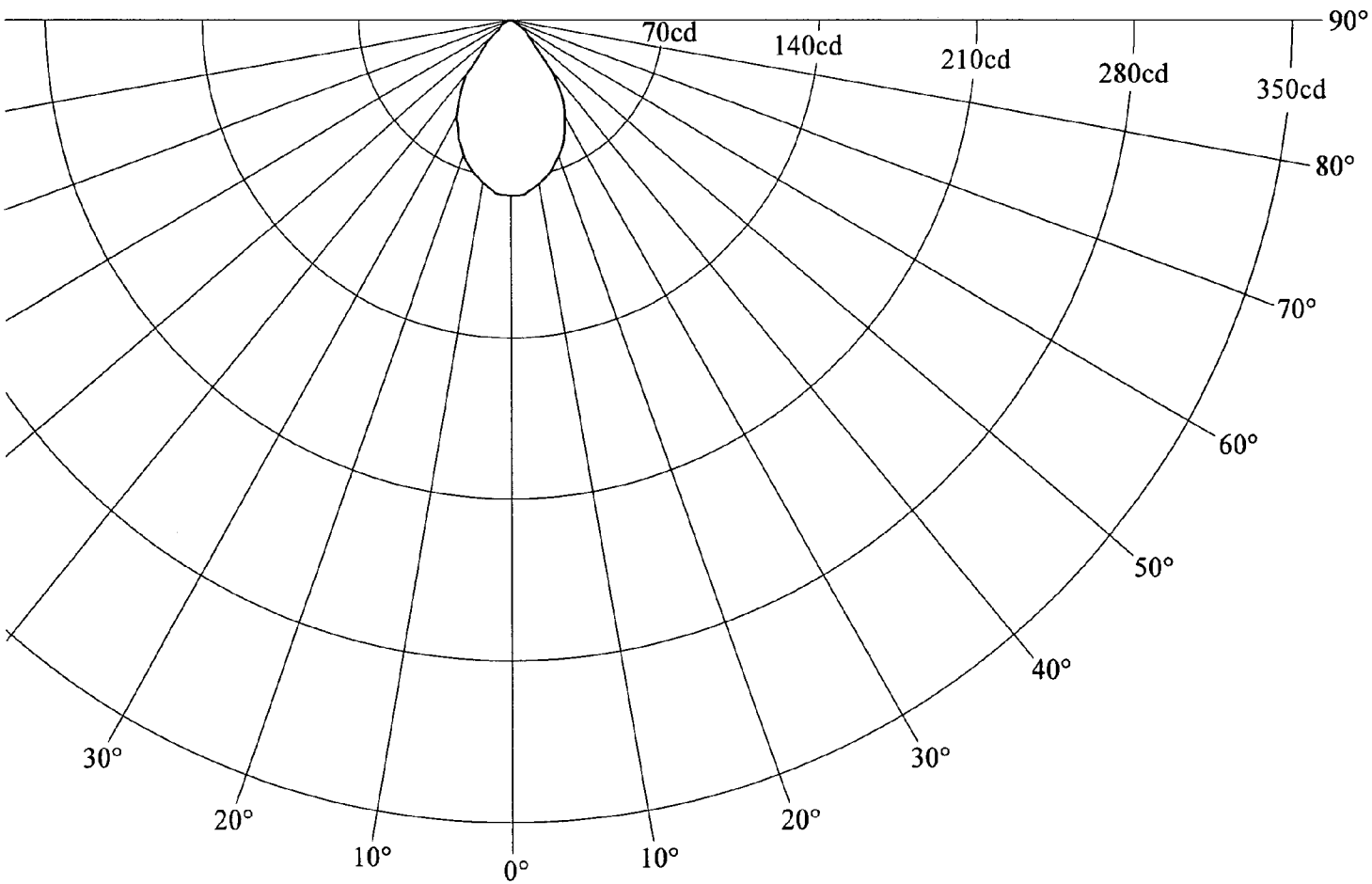
FIG. 7 shows a polar distribution in the vertical plane, scaled in candela, of a single LED with a Lambertian light distribution and without an orientable lens of the present invention in use.
Figure 8:
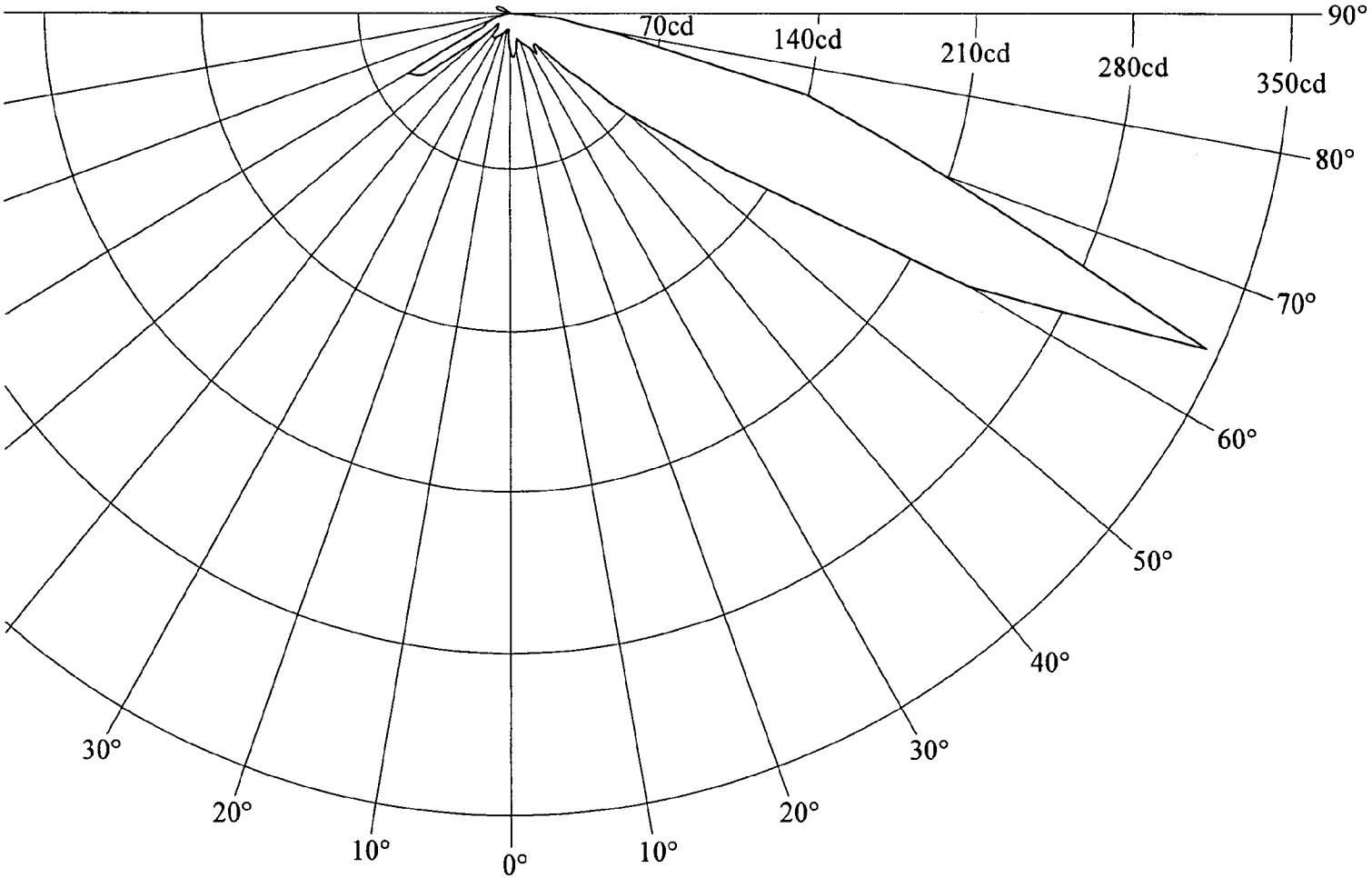
FIG. 8 shows a polar distribution in the vertical plane, scaled in candela, of the same LED of FIG. 7 with an embodiment of orientable lens of the present invention in use.
Figure 9:
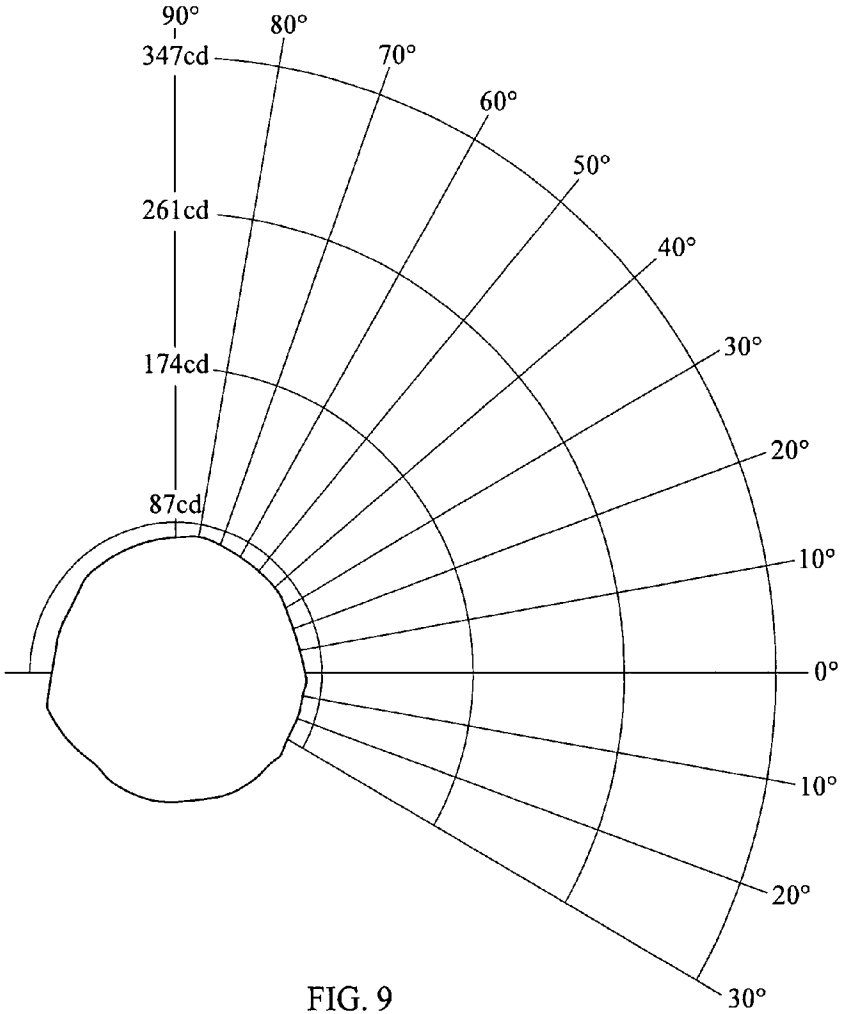
FIG. 9 shows a polar distribution in the horizontal plane, scaled in candela, of the same LED of FIG. 7 without an orientable lens of the present invention in use.
Figure 10:
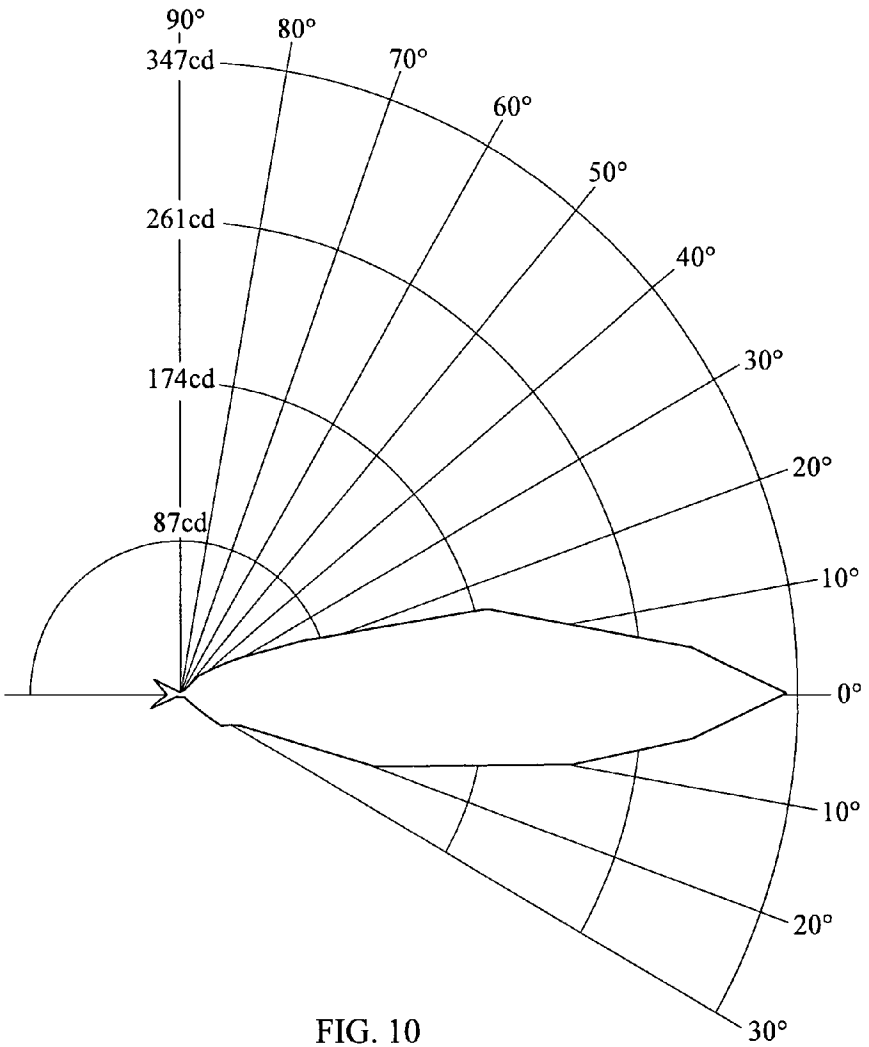
FIG. 10 shows a polar distribution in the horizontal plane, scaled in candela, of the same LED of FIG. 7 with the same orientable lens of FIG. 8 in use.

FIG. 7 shows a polar distribution in the vertical plane, scaled in candela, of a single LED with a Lambertian light distribution and without an orientable lens. FIG. 9 shows a polar distribution in the horizontal plane, scaled in candela, of the same led of FIG. 7. FIG. 8 shows a polar distribution in the vertical plane, scaled in candela, of the same LED of FIG. 7 with the embodiment of orientable lens showed in the figures in use. FIG. 10 shows a polar distribution in the horizontal plane, scaled in candela, of the same LED of FIG. 7 with the same orientable lens of FIG. 8 in use.

As can be seen from FIG. 8 and FIG. 10 orientable lens 10 directs a majority of light outputted by a LED with a Lambertian light distribution off a LED light output axis. In the vertical plane, shown in FIG. 8, a majority of the light is directed within a range from approximately 50° to 75° off the light output axis. In the horizontal plane, shown in FIG. 10, a majority of the light is directed within a 40° range away from the light output axis. Approximately 90% of light outputted by a LED with a Lambertian light distribution having the embodiment of orientable lens of FIG. 8 and FIG. 10 in use is distributed off the light output axis. FIG. 7-FIG. 10 are provided for purposes of illustration of an embodiment of orientable lens. Of course, other embodiments of orientable lens may be provided that produce differing polar distributions that direct light in a differing range off of and away from the light output axis. Thus, in the vertical plane of other embodiments light may be mainly directed in wider or narrower ranges and at a variety of angles away from the light output axis. In the horizontal plane of other embodiments light may likewise be directed in wider or narrower ranges.

The foregoing description has been presented for purposes of illustration. It is not intended to be exhaustive or to limit the invention to the precise forms disclosed, and obviously many modifications and variations are possible in light of the above teaching. It is understood that while certain forms of the orientable lens for a led fixture have been illustrated and described, it is not limited thereto except insofar as such limitations are included in the following claims and allowable functional equivalents thereof.

I claim:

1. An optical system for an LED fixture, comprising:

a mounting surface with a plurality of attached LEDs;

a plurality of orientable lenses each having a base;

wherein said base of each said orientable lens is affixed to said mounting surface about a single LED of said plurality of LEDs in a rotational orientation relative to said single LED;

said base of each said orientable lens being attached to a primary reflector, said primary reflector at least partially surrounding a refracting lens;

wherein said refracting lens and said primary reflector of each said orientable lens direct a majority of light emitted from said single LED to an angled reflective surface supported by said base and angled to reflect a majority of said light off a LED light output axis of said single LED.

2. The optical system for an LED fixture of claim 1, wherein said refracting lens and said primary reflector of each said orientable lens are attached by a sidewall extending from the periphery of said refracting lens toward a top of said primary reflector.

3. The optical system for an LED fixture of claim 1, wherein said reflective surface of each said orientable lens is angled to reflect a majority of said light in a vertical plane within a range of 50° to 75° off said LED light output axis.

4. The optical system for an LED fixture of claim 3, wherein said primary reflector, said refracting lens, and said reflective surface are configured to reflect a majority of said light in a horizontal plane within a range of 40° from said LED light output axis.

5. The optical system for an LED fixture of claim 1, wherein said reflective surface of each said orientable lens reflects said light off said primary LED light output axis to an optical lens of each said orientable lens, said optical lens attached to said reflector and extending toward said base.

6. The optical system for an LED fixture of claim 1, wherein said orientable lens is an integral molded unit.

7. The optical system for an LED fixture of claim 5, wherein said optical lens alters the direction of light passing therethrough.

8. The optical system for an LED fixture of claim 2, wherein a reflecting portion is provided attached to said sidewall of each said orientable lens adjacent said primary reflector and generally facing said refracting lens and wherein said reflecting portion of each said orientable lens directs a portion of light emitted from each said single LED and passing through said sidewall to said reflective surface.

9. The optical system for an LED fixture of claim 2, wherein said primary reflector is a parabolic reflector.

10. An optical system for an LED fixture, comprising:

a mounting surface with a plurality of LEDs attached;

a plurality of orientable lenses each having a base;

wherein said base of each said orientable lens is affixed to said mounting surface about a single LED of said plurality of LEDs in a rotational orientation relative to said single LED;

said base of each said orientable lens being attached to a primary reflector, said primary reflector at least partially surrounding a refracting lens;

wherein said refracting lens and said primary reflector direct a majority of light emitted from said single LED to a reflecting prism;

wherein said reflecting prism has an angled reflective surface and an optical lens for directing said light off a primary LED light output axis.

11. The optical system for an LED fixture of claim 10, wherein said refracting lens and said primary reflector of each said orientable lens are attached by a sidewall extending from the periphery of said refracting lens toward a top of said primary reflector.

12. The optical system for an LED fixture of claim 11, wherein a reflecting portion is provided attached to said sidewall of each said orientable lens adjacent said primary reflector and generally facing said refracting lens.

13. The optical system for an LED fixture of claim 12, wherein said reflecting portion of each said orientable lens directs a portion of light emitted from each said single LED and passing through said sidewall to said reflective surface of said reflecting prism of each said orientable lens.

14. The optical system for an LED fixture of claim 13, wherein a surface is provided substantially opposite said reflecting portion, adjacent said primary reflector, and generally facing said refracting lens.

15. The optical system for an LED fixture of claim 10, wherein said reflecting prism of each said orientable lens is positioned and configured to reflect a majority of said light in a vertical plane within a range of 50° to 75° off said primary LED light output axis.

16. The optical system for an LED fixture of claim 10, wherein each said orientable lens is configured and oriented to direct at least 70% of said light emitted from each said LED off said primary LED light output axis.

17. The optical system for an LED fixture of claim 10, wherein said optical lens alters the direction of light passing therethrough.

18. The optical system for an LED fixture of claim 11, wherein said primary reflector is a parabolic reflector.

19. The optical system for an LED fixture of claim 10, wherein said orientable lens is an integral molded unit.

20. The optical system for an LED fixture of claim 18, wherein said orientable lens is an integral molded unit.

21. An optical system for an LED fixture, comprising:

a plurality of LEDs attached to a mounting surface;

a plurality of orientable lenses, each said orientable lens having a base, a parabolic reflector, a refracting lens, and a reflective surface;

said base of each said orientable lens being affixed to said mounting surface about a single LED of said plurality of LEDS and supporting said parabolic reflector and said reflective surface;

said parabolic reflector of each said orientable lens at least partially surrounding a light emitting portion of said single LED and said refracting lens;

said reflective surface of each said orientable lens extending at an angle away from said base and intersecting a LED light output axis at an angle, said LED light output axis being outward and away from said mounting surface and centrally located in said light emitting portion of said single LED;

said refracting lens of each said orientable lens positioned between each said single LED and said reflective surface and intersecting said LED light output axis;

wherein said refracting lens and said parabolic reflector have a configuration and orientation wherein a majority of light rays emitted by said single LED contacts at least one of said refracting lens and said parabolic reflector and is directed towards and at least partially reflected by said reflective surface of each said orientable lens, thereby uniformly directing a majority of light rays incident upon said reflective surface within a predefined range of angles with respect to said LED light output axis.

22. The optical system for an LED fixture with an orientable lens of claim 21, wherein said orientable lens is an integral molded unit.

23. The optical system for an LED fixture of claim 22, wherein said refracting lens and said parabolic reflector of each said orientable lens are attached by a sidewall extending from the periphery of said refracting lens toward a top of said parabolic reflector.

24. The optical system for an LED fixture of claim 23, wherein a reflecting portion is provided attached to said sidewall of each said orientable lens adjacent said parabolic reflector and generally facing said refracting lens.

25. The optical system for an LED fixture of claim 24, wherein said reflecting portion of each said orientable lens directs a portion of light emitted from each said single LED and passing through said sidewall to said reflective surface of each said orientable lens.

26. The optical system for an LED fixture of claim 25, wherein a surface is provided substantially opposite said reflecting portion, adjacent said parabolic reflector, and generally facing said refracting lens.

27. The optical system for an LED fixture with an orientable lens of claim 21, wherein said majority of light rays incident upon said reflective surface of each said orientable lens are uniformly directed towards, and a substantial majority pass through, an optical lens attached to said reflective surface and extending towards said base of each said orientable lens.

28. The optical system for an LED fixture with an orientable lens of claim 27, wherein said optical lens of each said orientable lens is positioned and configured to alter said range of angles of said majority of light rays passing therethrough.

29. The optical system for an LED fixture with an orientable lens of claim 21, wherein said range of angles is from 50° to 75° off said LED light output axis in a vertical plane.

30. An optical system for an LED fixture having an LED board with a plurality of orientable lens mounted over individual LEDs, comprising:

a support surface having a plurality of LEDs electrically connected to a power source;

a plurality of orientable lens mountable to said surface, each orientable lens individually mounted over an individual LED, each of said orientable lens having:

a base portion retained on said surface substantially surrounding an LED;

a primary refracting lens situated over said LED;

a first and second primary reflector surrounding at least a portion of said primary refracting lens;

wherein said primary refracting lens and said first and second primary reflector redirect a majority of light output from said LED to an angled reflector, said angled reflector reflecting said light through an optical lens opposing said reflector.

31. An optical system for an LED fixture with an orientable lens, comprising:

a plurality of LEDs attached to a mounting surface;

a plurality of orientable lenses, each said orientable lens having a base, a parabolic reflector, a collimating lens, and a reflecting prism having a reflective surface and an optical lens;

said base of each said orientable lens affixed to said mounting surface about a single LED of said plurality of LEDS and supporting said parabolic reflector and said reflecting prism;

said parabolic reflector at least partially surrounding a light emitting portion of said single LED and said collimating lens;

said reflective surface extending at an angle away from said base and intersecting a LED light output axis at an angle, said LED light output axis being outward and away from said mounting surface and centrally located in said light emitting portion of said single LED;

said collimating lens positioned between said single LED and said reflective surface and intersecting said LED light output axis;

wherein said collimating lens and said parabolic reflector have a configuration and orientation wherein a majority of light rays emitted by said single LED contacts at least one of said collimating lens and said parabolic reflector and is directed towards and at least partially reflected by said reflective surface of said reflecting prism, thereby uniformly directing a majority of light rays incident upon said reflective surface away from said reflective surface, through said prism, and out said optical lens within a predefined range of angles with respect to said LED light output axis.

32. The optical system for an LED fixture with an orientable lens of claim 31, wherein said orientable lens is an integral molded unit.

33. The optical system for an LED fixture of claim 32, wherein said collimating lens and said parabolic reflector of each said orientable lens are attached by a sidewall extending from the periphery of said collimating lens toward a top of said parabolic reflector.

34. The optical system for an LED fixture with an orientable lens of claim 33, wherein said reflective surface of each said prism of each said orientable lens is configured to internally reflect a majority of said light rays incident upon said reflective surface away from said reflective surface.

35. The optical system for an LED fixture with an orientable lens of claim 34, wherein said optical lens of each said orientable lens is positioned and configured to alter said range of angles of said substantial majority of light rays passing therethrough.

36. The optical system for an LED fixture of claim 35, wherein a reflecting portion is provided attached to said sidewall of each said orientable lens adjacent said parabolic reflector and generally facing said collimating lens.

37. The optical system for an LED fixture of claim 36, wherein said reflecting portion of each said orientable lens directs a portion of light emitted from each said single LED and passing through said sidewall to reflective surface of said reflecting prism of each said orientable lens.

38. The optical system for an LED fixture of claim 37, wherein a surface is provided substantially opposite said reflecting portion, adjacent said parabolic reflector, and generally facing said collimating lens.

39. The optical system for an LED fixture of claim 38, wherein said orientable lens is formed from optical grade acrylic.

40. The optical system for an LED fixture of claim 39, wherein said mounting surface is a flat board.

41. The optical system for an LED fixture of claim 40, wherein said flat board is an aluminum flat board.

42. The optical system for an LED fixture of claim 31, wherein said mounting surface is a flat board.

* * * * *